United States Patent [19]

Miletic

[11] Patent Number: 4,591,813

[45] Date of Patent: May 27, 1986

[54] HYBRID JUNCTION HAVING THREE CONDUCTIVE LINES COAXIALLY DISPOSED

[75] Inventor: Igor Miletic, Scarborough, Canada

[73] Assignee: U.S. Philips Corporation, New York, N.Y.

[21] Appl. No.: 650,463

[22] Filed: Sep. 14, 1984

[30] Foreign Application Priority Data

Sep. 22, 1983 [CA] Canada ..... 437316

[51] Int. Cl.[4] ..... H01P 5/16

[52] U.S. Cl. ..... 333/117; 333/123

[58] Field of Search ..... 333/117, 116, 115, 120, 333/121, 123, 109, 246

[56] References Cited

U.S. PATENT DOCUMENTS 3,026,490 3/1962 Mumford et al. ..... 333/121

*Primary Examiner*—Eugene R. LaRoche
*Assistant Examiner*—Benny T. Lee
*Attorney, Agent, or Firm*—Robert J. Kraus

[57] ABSTRACT

A hybrid junction device formed by an intermediate conductor located between and spaced from an outer conductor and a central conductor. The conductors are all about λ/4 in length. A first port is connected between the central conductor and the outer conductor at one end of the device and a second port is connected between the intermediate conductor and the outer conductor at the other end of the device. A third port is connected between the intermediate and the outer conductor at one end of the device while a fourth port is connected between the central conductor and outer conductor at the other end. The conductors may be co-axial or stripline type conductors.

3 Claims, 3 Drawing Figures

HYBRID JUNCTION HAVING THREE CONDUCTIVE LINES COAXIALLY DISPOSED

BACKGROUND OF THE INVENTION

The invention relates to four-port hybrid junction networks which may be used as attenuators, phase shifters, signal combiners and splitters, mixers or modulators for high frequency or microwave apparatus.

These hybrid junctions are known in the prior art and belong to a class of hybrids in which ring and branch lines are used. A particular characteristic of these hybrid junctions is that there are two possible paths, from any port to any other port, differing so that signals arriving at a destination port oppose each other. This can be achieved by either insertion of a $\lambda/2$ long transmission line in one path or by use of an electrical reversal connection. The insertion of a $\lambda/2$ long transmission line in one path has an advantage of allowing a simple and inexpensive design but has the disadvantage of operating over a narrow frequency range due to the $\lambda/2$ long transmission line. The insertion of an electrical reversal connection performs better over a wider frequency range since the electrical reversal connection is, by itself, an item which is independent of the frequency. However, the designs involving an electrical reversal connection require a more complex type of arrangement.

U.S. Pat. No. 3,504.304 describes a hybrid network in which 4 sections of suitable transmission medium such as transmission lines, co-axial cables, waveguides or striplines are connected in a ring network with one arm connected so as to provide the needed 180° phase shift. This U.S. patent further describes a compensation circuit, such as a variable reactance circuit, which is connected to each of the four junctions of the network to compensate the ring in a manner which increases the operating bandwidth and/or decreases the input voltage standing wave ratio(VSWR) with decreasing isolation between conjugate arms of the network.

U.S. Pat. No. 3,654,570 describes an improvement on U.S. Pat. No. 3,358,248 which is directed to a four port coaxial hybrid junction in which a pair of insulated centre conductors extend side-by-side for a quarter wavelength in a manner permitting this pair of centre conductors to be substantially co-axial with an outer conductor, the improvement being an improved means for coupling signals into and out of a hybrid junction device.

U.S. Pat. No. 3,497,832 describes a four port magic tee type hybrid apparatus with a pair of sub members $\lambda/4$ long having inner conductor portions co-axial with respective tubular intermediate conductor members which are aligned parallel to and equidistant from outer ground plane members. This U.S. Pat. No. 3,497,832 illustrates in FIG. 6 a stripline configuration which is analogous to the pair of co-axial type stub members illustrated in FIG. 4.

SUMMARY OF THE INVENTION

It is an object of the present invention to provide an improved four port hybrid junction device which is extremely compact, simple in design and as a result has a low manufacturing cost.

It is a further object of the present invention to provide a hybrid junction device with an improved operating frequency range.

These objects are achieved in the present invention by a four port hybrid junction device consisting of an intermediate conductor located between and spaced from an outer conductor and a central conductor, all conductors being $\lambda/4$ long. A first port is connected at a first end of the device between the central conductor and the outer conductor. A second port is connected at an opposite second end of the device between the intermediate conductor and the outer conductor. A third port is connected at the first end between the intermediate conductor and the outer conductor. A fourth port is connected at the second end between the central conductor and the outer conductor.

In one embodiment of the present invention the conductors are co-axial conductors.

In a further embodiment of the present invention the conductors are stripline conductors with two intermediate conductors being connected together at the first and second ends and with the two outer conductors being connected together at the first and second ends.

BRIEF DESCRIPTION OF THE DRAWING

The invention can be better understood by reference to the following detailed description when considered together with the accompanying drawing in which.

DESCRIPTION OF THE PREFERRED EMBODIMENT

Figure 1:
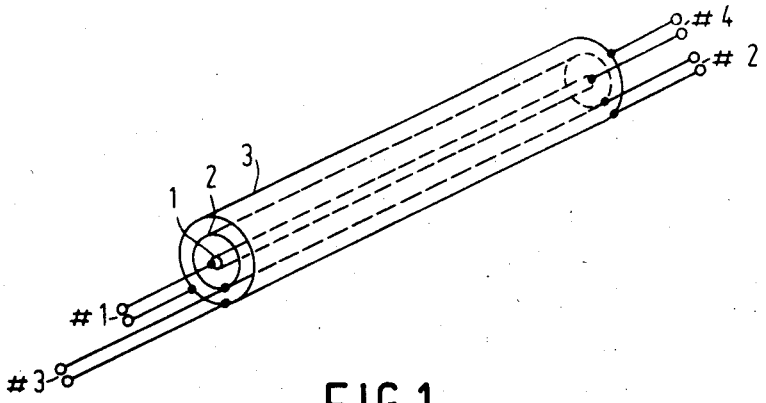
FIG. 1 illustrates a hybrid junction device according to the present invention using co-axial conductors.

FIG. 1 shows a hybrid junction device according to the present invention with a central conductor 1, an intermediate tubular conductor 2 co-axial with the central conductor and an outer tubular conductor 3 co-axial with the central and intermediate conductors. The conductors 1, 2 and 3 all have a length of $\lambda/4$. A first port #1 is connected to the central and outer conductors at the left end of the device while a second port #2 is connected to the intermediate and outer conductors at the opposite (right) end of the device. A third port #3 is connected to the intermediate and outer conductors at the left end and a fourth port #4 is connected to the central and outer conductors at the opposite end of the device.

Figure 2:
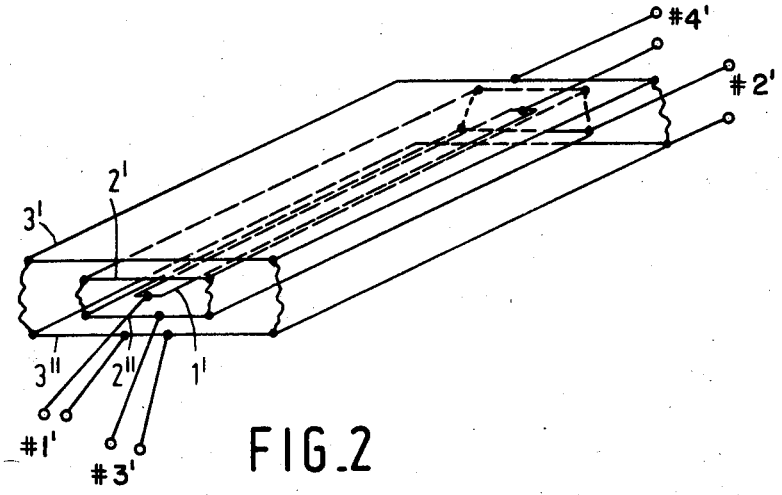
FIG. 2 illustrates a hybrid junction device according to the present invention using stripline conductors.

FIG. 2 shows an equivalent type of hybrid device similar to that shown in FIG. 1 using stripline conductors rather than co-axial tubular conductors. In this case the outer conductor 3 shown in FIG. 1 is replaced by two outer stripline conductors 3' and 3" which are electrically interconnected at the left end and at the opposite or right end of the device. In a similar manner, the intermediate tubular conductor 2 in FIG. 1 is replaced by two intermediate stripline conductors 2' and 2" which are electrically connected at the ends of the device. The central conductor is formed by a single stripline conductor 1'. All these conductors are $\lambda/4$ in length and are positioned with respect to each other in the manner shown in FIG. 2. Ports #1', #2', #3' and #4' are connected to the conductors as is illustrated in FIG. 2.

Figure 3:
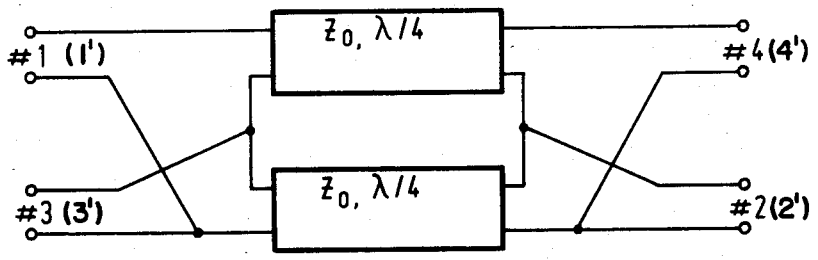
FIG. 3 shows an equivalent electrical diagram for the devices illustrated in FIGS. 1 and 2.

In order to provide a fuller description of the operation of the hybrid junctions shown in FIGS. 1 and 2, an equivalent electric circuit diagram is shown in FIG. 3. In this circuit diagram, ports #1(1') and #2(2') are symmetrical if terminations to ports #3(3') and #4(4') meet certain requirements. Also ports #3(3') and #4(4') are symmetrical if terminations to ports #1(1') and #2(2') meet certain requirements. For instance, the characteristic impedance of the transmission structure from port #1(1') to port #2(2') (or vice versa) equals Zo if terminations to ports #3(3') and #4(4') have a ratio 1:4. In this case, if both terminations at ports #3(3') and #4(4') are real impedances, an attenuator is formed from port #1(1') to port #2(2') and if the terminations are imaginary impedances, then a phase shifter is formed from ports #1(1') to #2(2').

When the terminations to ports #3(3') and #4(4') shown in FIG. 3 are short circuited or open circuited, a phase shift of ±90° is obtained, with no attenuation involved, between ports #1(1') and #2(2'), However, if the termination to port #3(3') is real and equal to Zo/2 while the termination to port #4(4') is also real and equals 2Zo, then ports #1(1') and #2(2') are mutually isolated, i.e. an infinite attenuation is obtained.

It can be shown that the admittance matrix, [y] of the hybrid junction shown in FIG. 3 is:

$$[y] = -j\gamma_o \frac{1}{\sin\theta}\begin{bmatrix} \cos\theta & 1 & -\cos\theta & -1 \\ 1 & 2\cos\theta & -2 & -\cos\theta \\ -\cos\theta & -2 & 2\cos\theta & 1 \\ -1 & -\cos\theta & 1 & \cos\theta \end{bmatrix}$$

where:

$\theta$ is electrical length of the conductors in radians or degrees,

Yo is characteristic admittance equal to 1/Zo, as defined per FIGS. 1, 2 and 3, and assuming negligible transmission losses in the junction hybrid as defined per FIG. 3.

Selecting the electrical length of $\theta=90°$ (physical length equal to $\lambda/4$) derived are properties of the hybrid junction described above.

While two specific embodiments of the invention have been described, it is to be understood that various modifications may be made without departing from the spirit and scope of the invention as defined in the appended claims.

What is claimed is:

1. A hybrid junction device for operating at a wavelength $\lambda$, said device comprising:

(a) a central conductor extending between first and second ends thereof over a length $\lambda/4$;

(b) an outer coaxial conductor extending between first and second ends thereof over a length $\lambda/4$, said outer coaxial conductor being coaxially disposed around the central conductor;

(c) an intermediate coaxial conductor extending between first and second ends thereof over a length $\lambda/4$, said intermediate coaxial conductor being coaxially disposed between the central conductor and the outer coaxial conductor;

(d) a first port electrically connected to the first ends of the central and outer conductors;

(e) a second port electrically connected to the second ends of the intermediate and outer conductors;

(f) a third port electrically connected to the first ends of the intermediate and outer conductors; and (g) a fourth port electrically connected to the second ends of the central and outer conductors.

2. A hybrid junction device for operating at a wavelength $\lambda$, said device comprising:

(a) a central strip conductor extending between first and second ends thereof over a length $\lambda/4$;

(b) a pair of electrically connected outer stip conductors extending between first and second ends thereof over a length $\lambda/4$, said outer strip conductors being equidistantly spaced from respective opposite sides of the central strip conductor;

(c) a pair of electrically connected intermediate strip conductors extending between first and second ends thereof over a length $\lambda/4$, each of said intermediate strip conductors being disposed between and equidistantly spaced from the central conductor and a respective one of the outer strip conductors;

(d) a first port electrically connected to the first ends of the central and outer conductors;

(e) a second port electrically connected to the second ends of the intermediate and outer conductors;

(f) a third port electrically connected to the first ends of the intermediate and outer conductors; and (g) a fourth port electrically connected to the second ends of the central and outer conductors.

3. A hybrid junction device for operating at a wavelength $\lambda$, said device comprising:

(a) a central conductive means extending between first and second ends thereof over a length $\lambda/4$;

(b) an outer conductive means extending between first and second ends thereof over a length $\lambda/4$, said outer conductive means having electrically-connected portions thereof equidistantly spaced from respective opposite sides of the central conductive element;

(c) an intermediate conductive means extending between first and second ends thereof over a length $\lambda/4$, said intermediate conductive means having electrically-connected portions thereof disposed between and equidistantly spaced from the central conductive means and the outer conductive means;

(d) a first port electrically connected to the first ends of the central and outer conductive means;

(e) a second port electrically connected to the second ends of the intermediate and outer conductive means;

(f) a third port electrically connected to the first ends of the intermediate and outer conductive means; and (g) a fourth port electrically connected to the second ends of the central and outer conductive means.

* * * * *